US011035388B1

(12) United States Patent
Sun

(10) Patent No.: US 11,035,388 B1
(45) Date of Patent: Jun. 15, 2021

(54) ACCELERATOR-EQUIPPED PNEUMATIC CYLINDER

(71) Applicant: Chen Sound Industrial Co., Ltd., Taichung (TW)

(72) Inventor: Ying Sun, Taichung (TW)

(73) Assignee: CHEN SOUND INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/021,332

(22) Filed: Sep. 15, 2020

(30) Foreign Application Priority Data

Feb. 15, 2020 (TW) ..... 109201679

(51) Int. Cl.

| | |
|---|---|
| ***F15B 15/22*** | (2006.01) |
| ***F15B 13/02*** | (2006.01) |
| ***F15B 13/04*** | (2006.01) |
| ***F15B 15/14*** | (2006.01) |
| ***F15B 15/20*** | (2006.01) |

(52) U.S. Cl.
CPC ..... *F15B 13/021* (2013.01); *F15B 13/0402* (2013.01); *F15B 15/149* (2013.01); *F15B 15/1428* (2013.01); *F15B 15/1447* (2013.01); *F15B 15/202* (2013.01); *F15B 15/221* (2013.01)

(58) Field of Classification Search
CPC .. F15B 13/021; F15B 13/0402; F15B 15/149; F15B 15/19; F15B 15/202; F15B 15/221
See application file for complete search history.

(56) References Cited

U.S. PATENT DOCUMENTS

| | | | | | |
|---|---|---|---|---|---|
| 2,925,803 | A * | 2/1960 | Ottestad | F15B 15/221 | 91/396 |
| 2,949,096 | A * | 8/1960 | Ottestad | F16K 1/38 | 91/396 |
| 2,979,938 | A * | 4/1961 | Ottestad | F15B 15/221 | 73/12.07 |
| 2,986,120 | A * | 5/1961 | Murek | F15B 15/221 | 91/29 |
| 2,994,302 | A * | 8/1961 | Murek | F15B 15/221 | 91/29 |
| 3,136,220 | A * | 6/1964 | Kamm | F15B 15/149 | 91/165 |
| 3,823,600 | A * | 7/1974 | Wolff | G01N 3/307 | 73/12.07 |

FOREIGN PATENT DOCUMENTS

TW M441540 U 11/2012

* cited by examiner

*Primary Examiner* — Michael Leslie
(74) *Attorney, Agent, or Firm* — Muncy, Geissler, Olds & Lowe, P.C.

(57) ABSTRACT

An accelerator-equipped pneumatic cylinder includes a cylinder block, a switch valve, and pneumatic cylinder. The cylinder block defines therein a piston chamber and a pressure chamber. The switch valve has a valve seat installed in the cylinder block and between the piston chamber and the pressure chamber. A controller is installed in the valve seat for controlling the piston chamber and the pressure chamber to be communicated with each other or not. The pneumatic cylinder has a piston portion received in the piston chamber, and has a shaft portion extending outward from the cylinder block. At a moment when a channel is made opened by the controller and the piston chamber and the pressure chamber come into communication with each other, the piston portion is pushed by a pressure medium at an accelerated speed, so that the shaft portion is pushed outside the piston chamber at the accelerated speed.

7 Claims, 9 Drawing Sheets

ACCELERATOR-EQUIPPED PNEUMATIC CYLINDER

BACKGROUND OF THE INVENTION

1. Field of the Invention

The present invention relates to an accelerator-equipped pneumatic cylinder, and more particularly to a mechanism used in a pneumatic cylinder for accelerated motion.

2. Description of the Related Art

A conventional automated machine tool has a spindle configured to be combined with various tools stored in a tool magazine for various processing operations like milling, drilling, and boring. For such a machine tool to use different tools in a tool magazine, a tool changing mechanism is provided to change tools efficiently. During the tool-changing operation, a tool arm first holds a tool that is now attached to the spindle and a pneumatic cylinder working with a multiplier mechanism performs the unclamping operation to make the tool leave the spindle. Then the tool arm moves the tool away for another tool to install.

Taiwan Patent Publication No. M441540 discloses a multiplier-equipped unclamping cylinder for addressing the problem of the prior art about insufficient unclamping force. It comprises a first actuator unit, a second actuator unit, and an unclamping unit. It uses a first switch and a second switch to switch between selections, so that the first compressed-air source and a second compressed-air source can simultaneously help the unclamping cylinder to intake air or drain air, thereby accelerating its unclamping operation with a multiplied downward force.

However, for accelerating the unclamping operation, the conventional unclamping cylinder has to employ two actuator units, as well as two switches and two compressed-air sources. This causes the resulting unclamping cylinder to have numerous components and become complicated in structure, leading to increased costs. Besides, since the compressed-air sources are not stable enough to hold a constant pressure, once the pressure is lowered, the unclamping operation of the unclamping cylinder is degraded. Hence, the prior art needs to be further improved.

SUMMARY OF THE INVENTION

To address the foregoing issues, the present invention provides an accelerator-equipped pneumatic cylinder, which features a cylinder block formed with a pressure chamber, and uses a controller to make the pressure chamber and the piston chamber communicated with each other or not. When there is pressure introduced in the pressure chamber and accumulated to a predetermined pressure level, the controller makes the pressure chamber and the piston chamber come into communication with each other, and the accumulated pressure is used to push the pneumatic cylinder at an accelerated speed.

The present invention in one embodiment provides an accelerator-equipped pneumatic cylinder, comprising: a cylinder block, having a piston chamber and a pressure chamber; a switch valve, having a valve seat that is installed in the cylinder block and stands between the piston chamber and the pressure chamber, the valve seat having a channel, a controller being installed in the valve seat for making the piston chamber and the pressure chamber communicated with each other or not by opening or closing the channel; and a pneumatic cylinder, having a piston portion receiving in the piston chamber, and having a shaft portion extending outward from one side of the piston portion to be exposed outside the cylinder block, so that when the channel is closed by the controller and the piston chamber and the pressure chamber are not communicated with each other, a pressure medium supplied into the pressure chamber by a pressure source is accumulated to a predetermined pressure level, and at a moment when the channel is opened by the controller and the piston chamber and the pressure chamber come into communication with each other, the piston portion is pushed by the pressure medium at the predetermined pressure level, so that the shaft portion is pushed out the piston chamber at an accelerated speed.

Thereby, with the pressure chamber formed in the cylinder block that allows the pressure medium from the pressure source to be introduced and accumulated therein, at the moment when the controller makes the pressure chamber and the piston chamber come into communication with each other, the piston portion is pushed by the pressure medium at the predetermined pressure level and has the shaft portion making a dash outward the piston chamber. In other words, the disclosed cylinder block has the pressure chamber in addition to the piston chamber, and uses the controller to allow the shaft portion to come out the piston chamber with a dash. Even in the event of discontinuation of the external compressed-air source, the accumulated pressure medium can push the shaft portion out the piston chamber. Therefore, the present invention is effective yet involves fewer and simpler components, thereby saving costs.

DETAILED DESCRIPTION OF THE INVENTION

Figure 1:
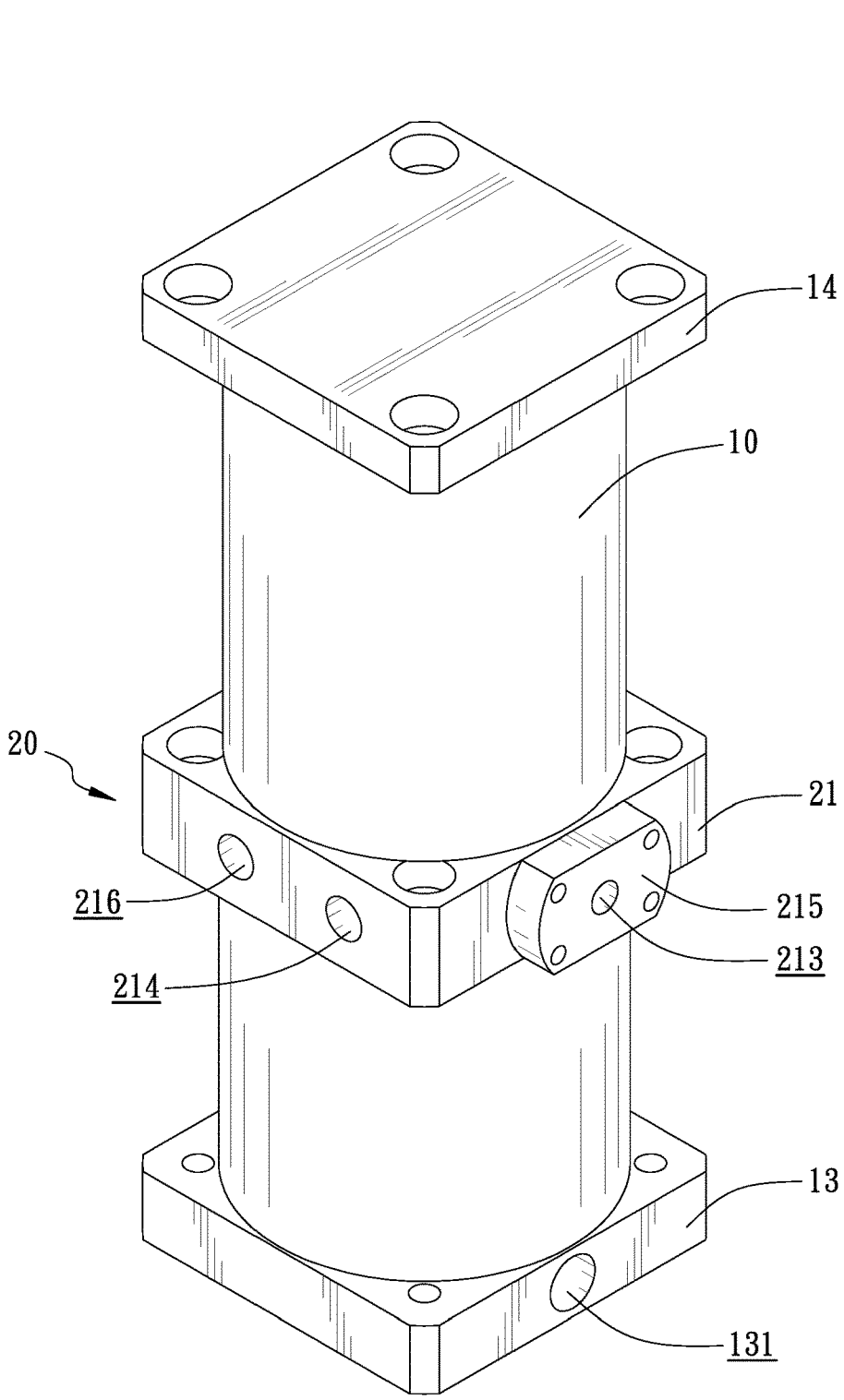
FIG. 1 is a perspective view of an accelerator-equipped pneumatic cylinder of the present invention.
Figure 2:
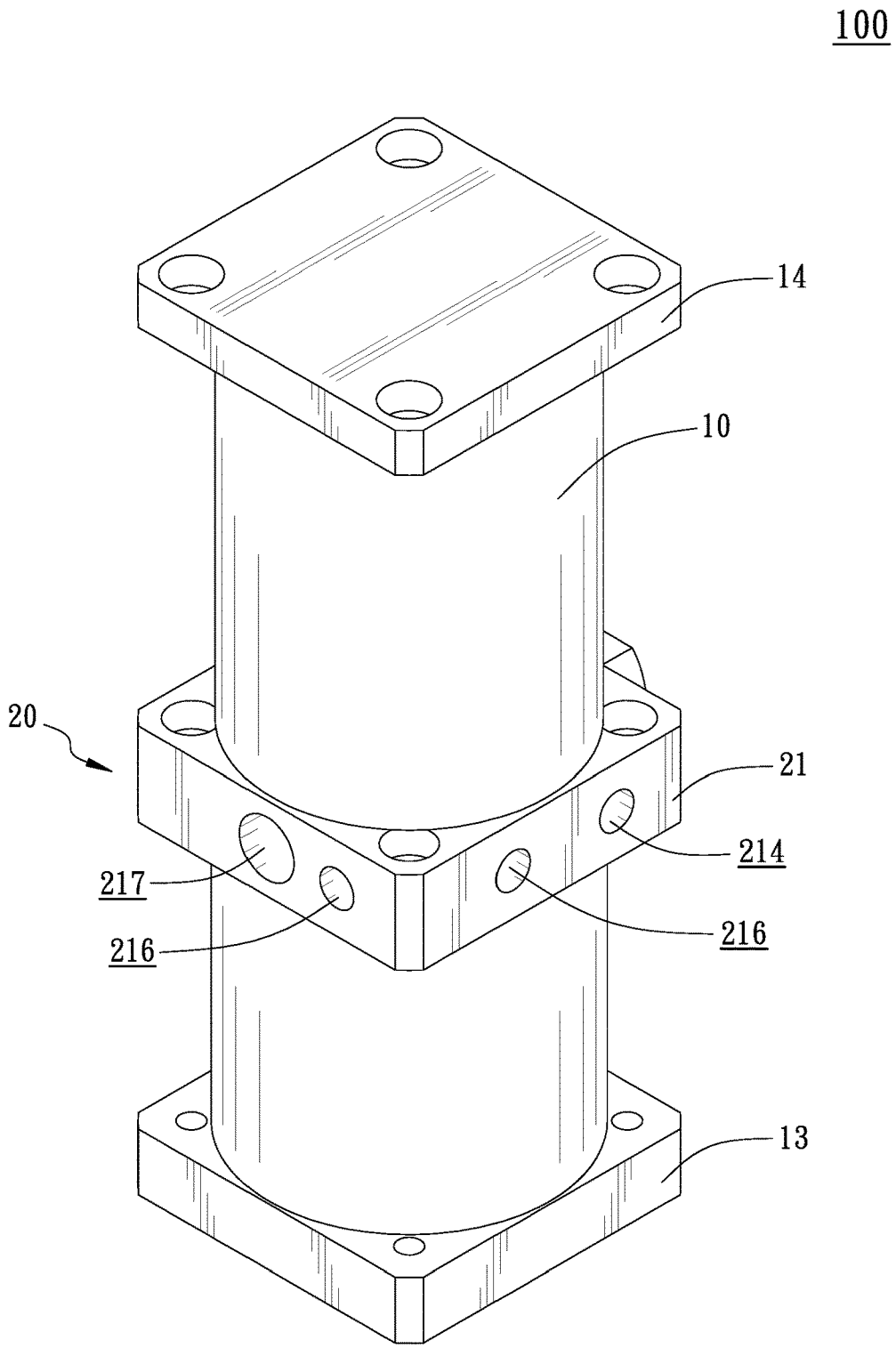
FIG. 2 is another perspective view of the accelerator-equipped pneumatic cylinder of the present invention taken from a different angle.

The following preferred embodiments when read with the accompanying drawings are made to clearly exhibit the above-mentioned and other technical contents, features and effects of the present invention. Through the exposition by means of the specific embodiments, people would further understand the technical means and effects the present invention adopts to achieve the above-indicated objectives. However, the accompanying drawings are intended for reference and illustration, but not to limit the present invention and are not made to scale.

Referring to FIG. 1 through FIG. 9, in one preferred embodiment, the present invention provides an accelerator-equipped pneumatic cylinder 100. The pneumatic cylinder 100 in the present embodiment is used as an unclamping cylinder, but not limited thereto. The pneumatic cylinder 100 primarily comprises a cylinder block 10, a switch valve 20, and a pneumatic cylinder 30.

The cylinder block 10 has a piston chamber 11 and a pressure chamber 12. In the present embodiment, the cylinder block 10 is columnar. The cylinder block 10 has one end corresponding to the piston chamber 11 provided with a first end cap 13, and has one end corresponding to the pressure chamber 12 provided with a second end cap 14. In the present embodiment, the first end cap 13 is shaped as a rectangular block, and the second end cap 14 is also shaped as a rectangular block. The first end cap 13 is formed with a first through hole 131 that is communicated with the piston chamber 11.

Figure 4:
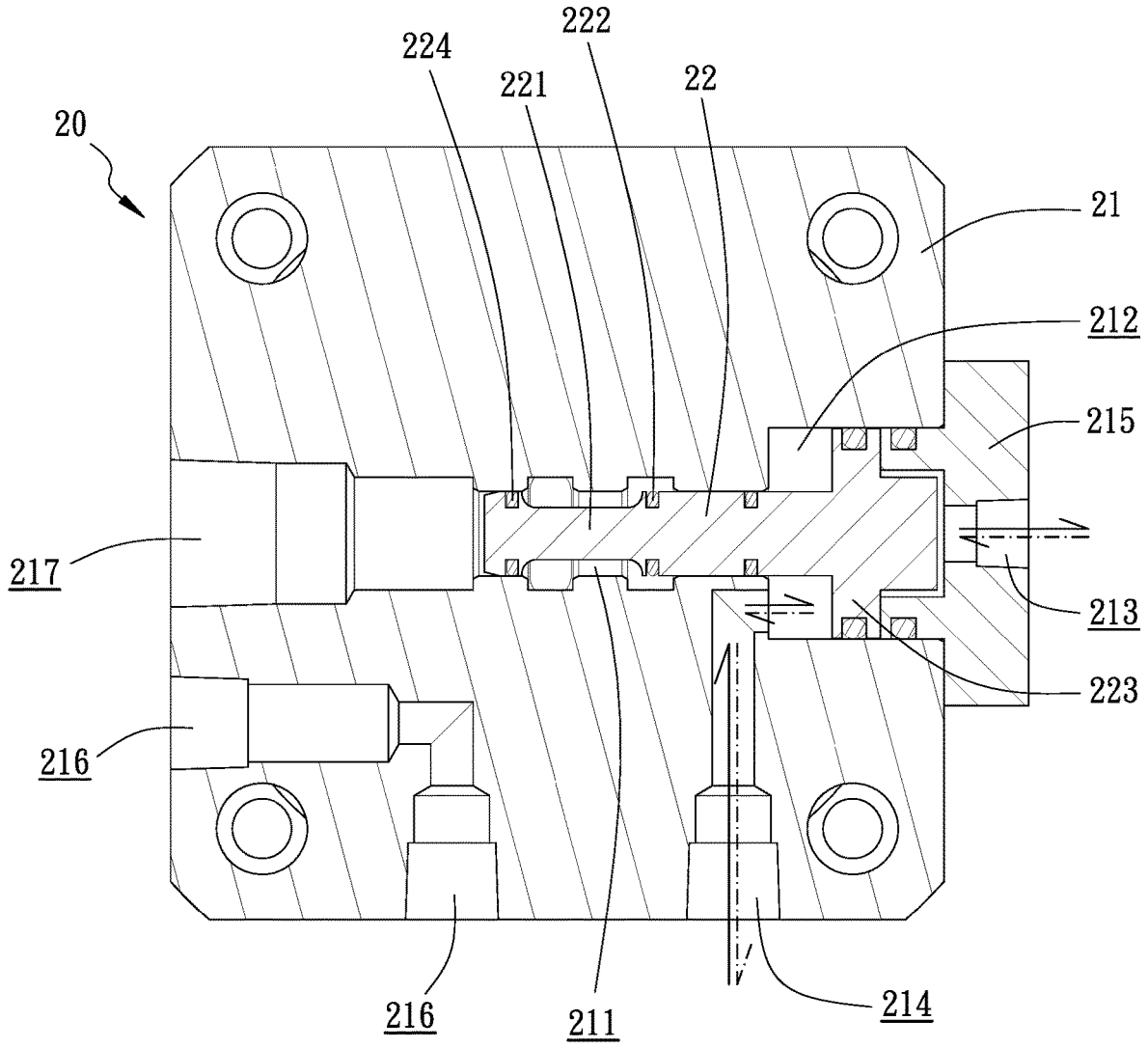
FIG. 4 is a cross-sectional view taken along Line 4-4 in FIG. 3.
Figure 5:
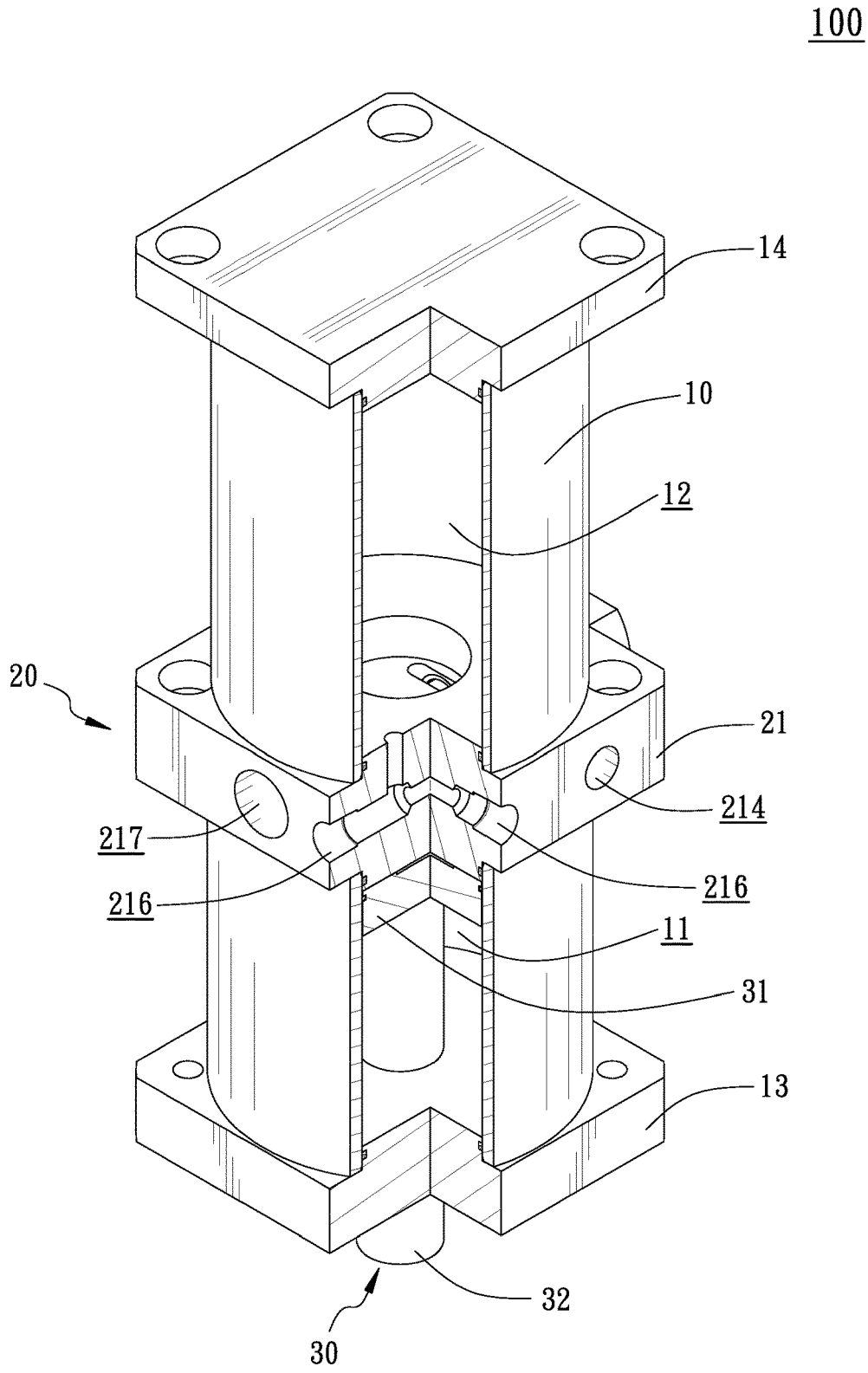
FIG. 5 is a partially cut away view of the accelerator-equipped pneumatic cylinder of the present invention particularly showing two communicating holes.

The switch valve 20 has a valve seat 21 such installed in the cylinder block 10 that it stands between the piston chamber 11 and the pressure chamber 12. The valve seat 21 has a channel 211. In the present embodiment, the valve seat 21 defines therein an operation chamber 212, whose two ends are provided with a first runner 213 and a second runner 214. The operation chamber 212 is communicated with the outside of the valve seat 21 through the first runner 213 and the second runner 214, respectively (as shown in FIGS. 1 and 4). In the present embodiment, the valve seat 21 is shaped as a rectangular block. The valve seat 21 has a flange 215 positionally corresponding to the first runner 213. The flange 215 protrudes from the valve seat 21. The valve seat 21 in the present embodiment has two communicating holes 216. Both of the two communicating holes 216 are communicated with the pressure chamber 12 (as shown in FIG. 5). The communicating holes 216 allow the pressure source P to supply a pressure medium into the pressure chamber 12 where the pressure medium is accumulated to a predetermined pressure level, and also allow the pressure medium in the pressure chamber 12 to be released. The valve seat 21 further has a second through hole 217 communicated with the channel 211. In the present embodiment, the second through hole 217 and the operation chamber 212 are at two ends of the channel 211, respectively. Therein, the second through hole 217 and the channel 211 may be communicated with each other, while the operation chamber 212 and the channel 211 are not communicated with each other.

Figure 6:
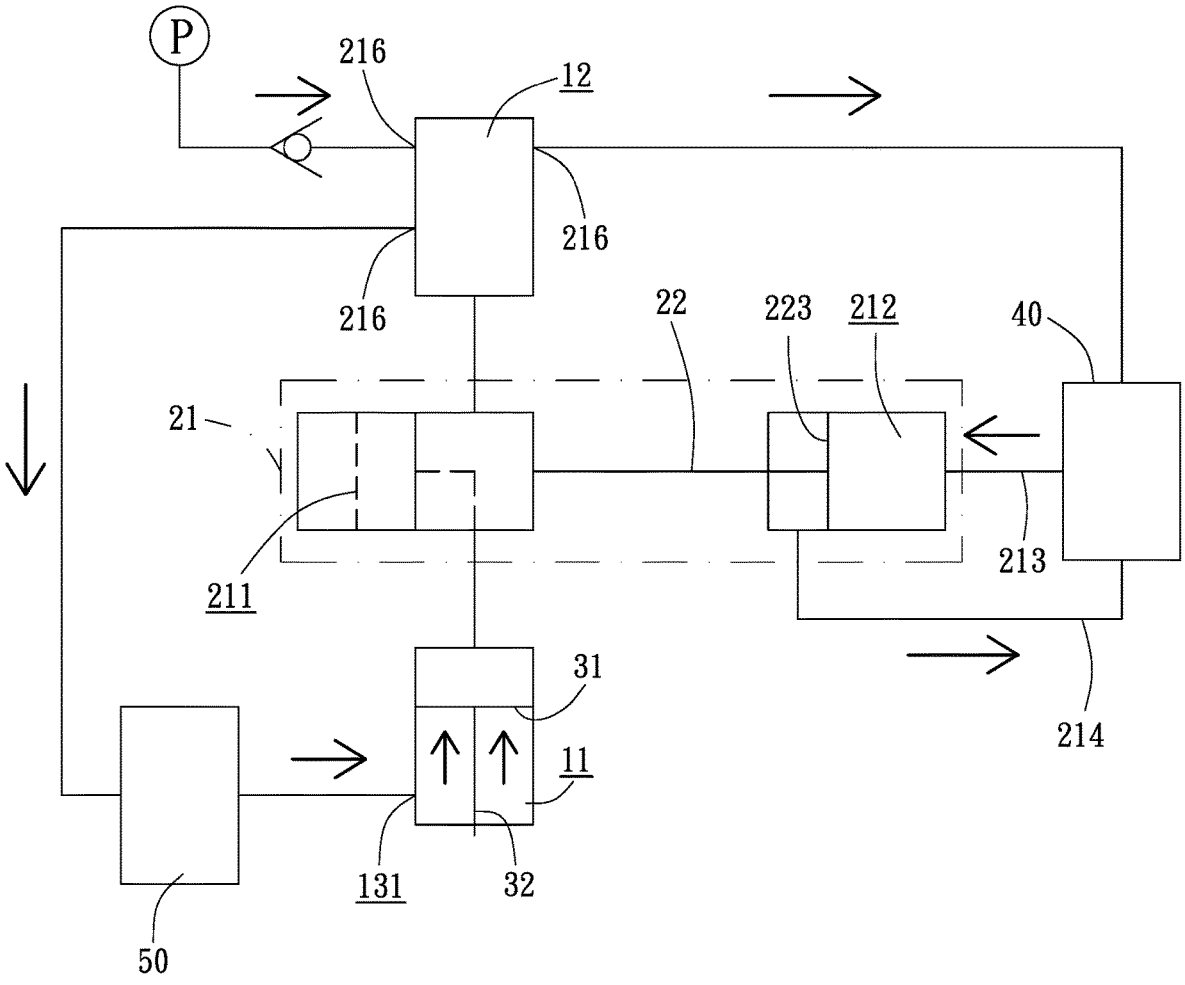
FIG. 6 is a loop diagram of an accelerator-equipped pneumatic cylinder of the present invention, showing that a piston chamber and a pressure chamber are not communicated with each other and a shaft portion of the pneumatic cylinder is retracted into the piston chamber.
Figure 7:
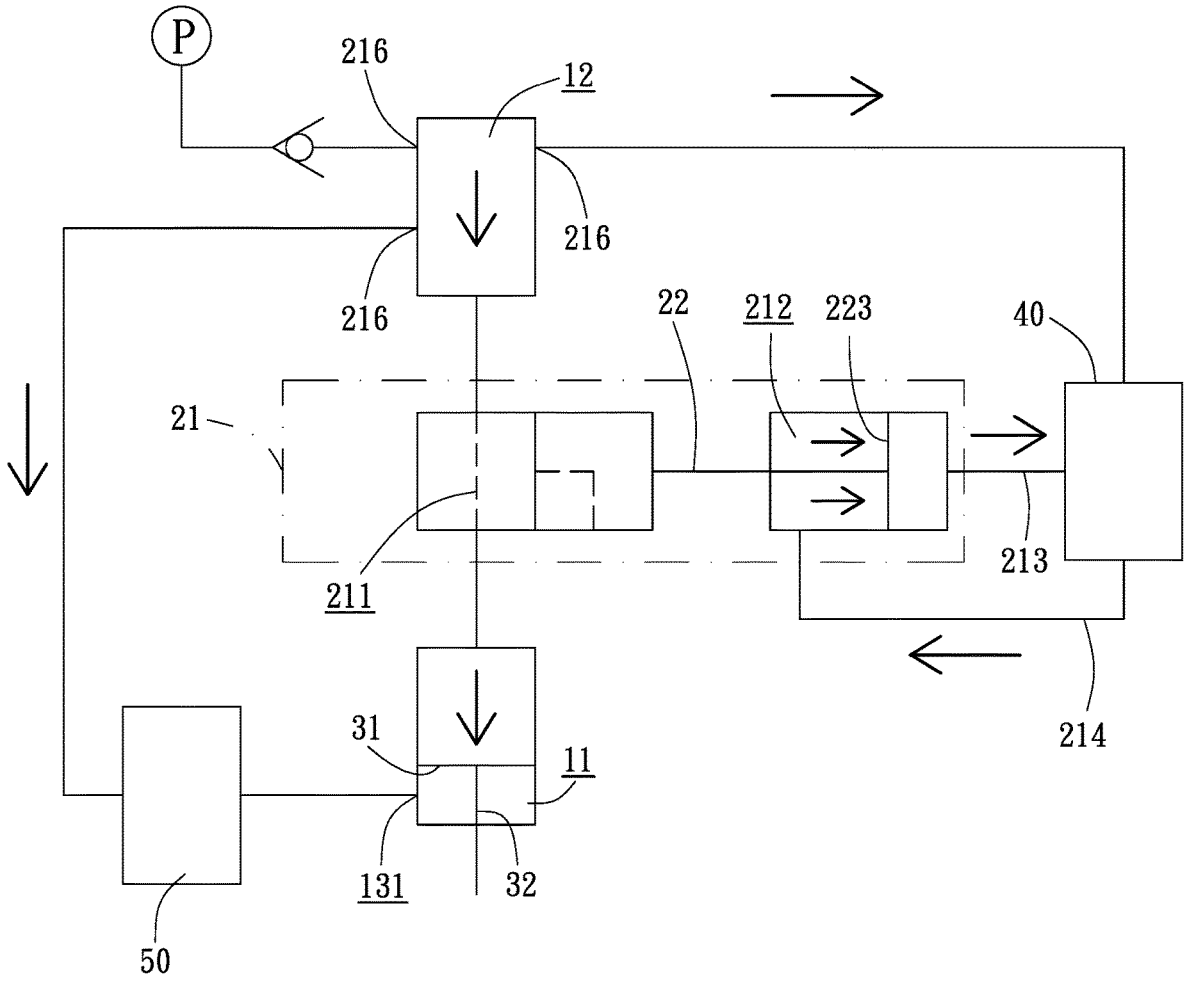
FIG. 7, based on FIG. 6, is a loop diagram showing that the piston chamber and the pressure chamber are communicated with each other, and the shaft portion of the pneumatic cylinder extends outside the piston chamber.

The pressure source P (as shown in FIGS. 6 and 7) in the present invention refers to a source of pressure medium, or referred to as a high-pressure fluid, that provides a driving force and the pressure medium is the high-pressure fluid. The high-pressure fluid may be, for example, high-pressure gas (providing a pneumatic force) or high-pressure liquid (providing a hydraulic force). In the present embodiment, the pressure source P supplies high-pressure gas. Additionally, the pressure source P is configured to not only push the drive portion 223, but also act as a force source for other components. For example, the pressure source P supplies the pressure medium into the pressure chamber 12 where the pressure medium is accumulated to the predetermined pressure level.

The switch valve 20 has a controller installed in the valve seat 21. The controller serves to open and close the channel 211, thereby making the piston chamber 11 and the pressure chamber 12 communicated with each other or making the piston chamber 11 and the pressure chamber 12 not communicated with each other. In the present embodiment, the controller is a valve stem 22. The valve stem 22 is installed in the valve seat 21 in an axially movable manner. The valve stem 22 pass through the channel 211. The valve stem 22 has a small-diameter segment 221, which is formed on the valve stem 22 by reducing the diameter of the valve stem 22 itself. The small-diameter segment 221 is positionally corresponding to the channel 211. The valve stem 22 has one end with the small-diameter segment 221 provided with a front retaining ring 222. The valve stem 22 moves axially in the valve seat 21 to make the front retaining ring 222 enter the channel 211, thereby closing the channel 211, or to retract the front retaining ring 222 from the channel 211, thereby allowing the small-diameter segment 221 to make the channel 211 open.

Figure 3:
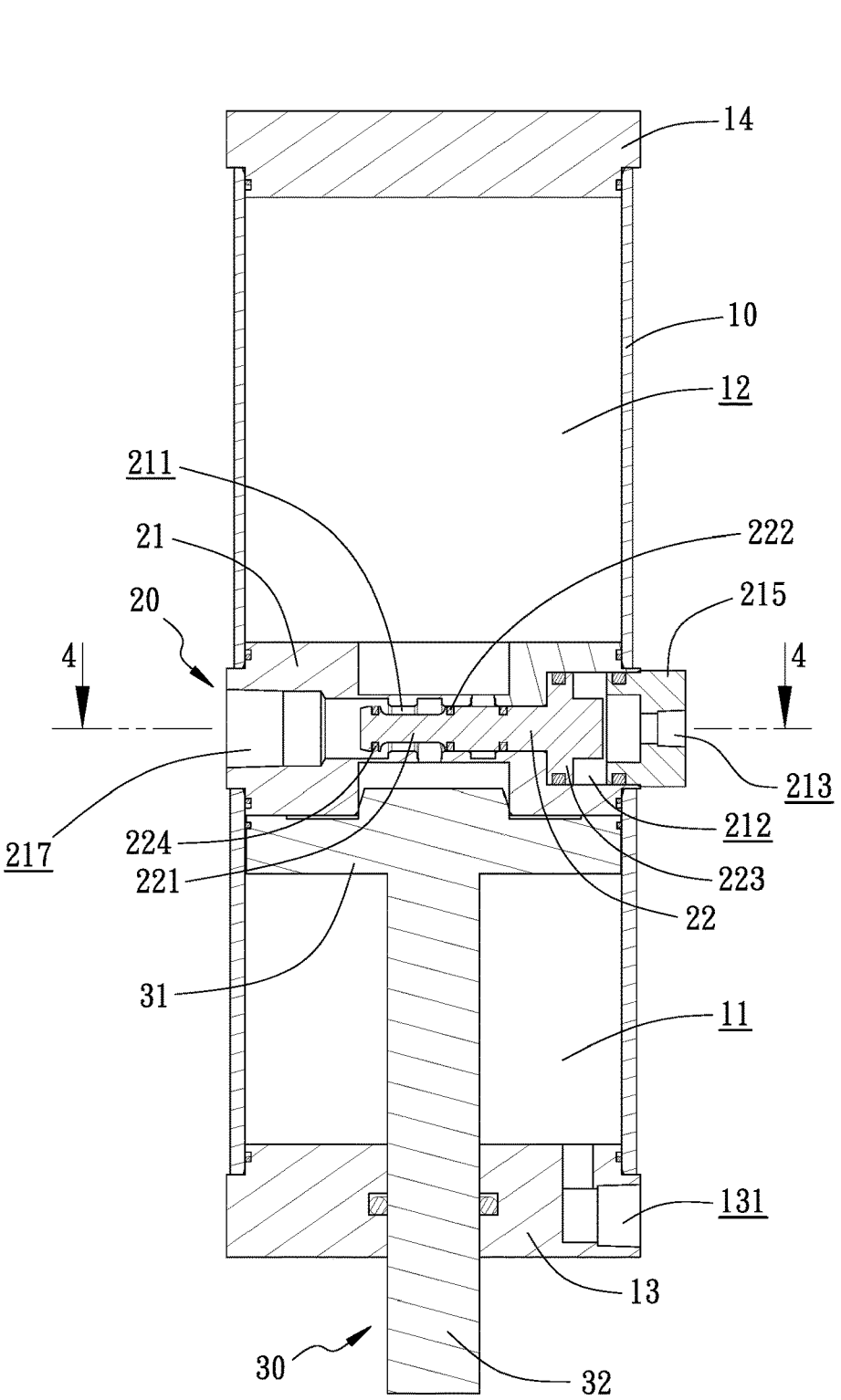
FIG. 3 is a cross-sectional view of the accelerator-equipped pneumatic cylinder of the present invention.

In the present embodiment, the valve stem 22 has one end provided with a drive portion 223. The drive portion 223 is received in the operation chamber 212. The pressure source P when supplying the pressure medium into the operation chamber 212 through the first runner 213 pushes the drive portion 223 to drive the valve stem 22 to axially move, thereby making the front retaining ring 222 close the channel 211 (as shown in FIG. 6). Alternatively, the pressure source P when supplying the pressure medium into the operation chamber 212 through the second runner 214, pushes the drive portion 223 in an opposite direction to make the valve stem 22 axially move and in turn retract the front retaining ring 222 from the channel 211, thereby opening the channel 211 (as shown in FIG. 7). Moreover, in the present embodiment, the valve stem 22 is provided with a rear retaining ring 224 at its end opposite to the small-diameter segment 221, so that when the valve stem 22 axially moves to make the front retaining ring 222 close the channel 211, the channel 211 and the second through hole 217 come into communication with each other. At this time, the channel 211, with the second through hole 217 acting as its return passage, start to drain the high-pressure gas (as shown in FIG. 3). On the other hand, when the valve stem 22 axially moves to retract the front retaining ring 222 from the channel 211 and thereby open the channel 211, the rear retaining ring 224 closes the second through hole 217, so as to prevent the channel 211 from communication with the second through hole 217. At this time, the channel 211 is prevented from draining the high-pressure gas through the second through hole 217 (as shown in FIG. 4). The pneumatic cylinder 30 has a piston portion 31 received in the piston chamber 11 and a shaft portion 32 extending outward the cylinder block 10 from one side of the piston portion 31. When the channel 211 is closed by the controller and the piston chamber 11 and the pressure chamber 12 are not communicated with each other, the pressure chamber 12 receives the pressure medium from the pressure source P that is accumulated to the predetermined pressure level. At the moment when the channel 211 is opened by the controller and the piston chamber 11 and the pressure chamber 12 come into communication, the piston portion 31 is pushed by the pressure medium at the predetermined pressure level at an accelerated speed, so the shaft portion 32 is pushed outside the piston chamber 11. The dash performed by the shaft portion 32 is thus useful to unclamp a tool. The predetermined pressure level refers to a pressure level that is high enough to make the shaft portion 32 perform such dash when it comes out from the piston chamber 11 pressure. The predetermined pressure level is not limited to any constant but determined according to practical unclamping needs.

In the present embodiment, the first runner 213 and the second runner 214 are connected to a solenoid valve, respectively, and further connected to the pressure chamber 12 through the solenoid valve. The solenoid valve mainly serves to control whether the pressure source P supplies the pressure by way of the first runner 213 or by way of the second runner 214. In the present embodiment, the solenoid valve is a two-way solenoid valve 40 (as shown in FIGS. 6 and 7), and is particularly a five-mouth three-place solenoid valve. In the present embodiment, the first through hole 131 formed on the first end cap 13 is communicated with the pressure chamber 12, and a one-way solenoid valve 50 (as shown in FIGS. 6 and 7) is arranged between the first through hole 131 and the pressure chamber 12. In the present embodiment, the pressure source P is connected to a communicating hole 216, while the two-way solenoid valve 40 and the one-way solenoid valve 50 are connected to the other communicating hole 216, respectively. While the two-way solenoid valve 40 and the one-way solenoid valve 50 are connected to the communicating hole 216 at different sites as depicted in FIGS. 6 and 7, this is only for illustration and they are actually connected to the same communicating hole 216.

When powered and magnetically excited, the two-way solenoid valve 40 introduces the pressure medium from the pressure source P into the operation chamber 212 through the first runner 213 so as to push the drive portion 223 (as shown in FIG. 6). The valve stem 22 is then driven to axially move and make the front retaining ring 222 enter the channel 211 to close the channel 211 (as shown in FIG. 3). The high-pressure gas in the operation chamber 212 is drained through the second runner 214. At this time, the shaft portion 32 returns to the piston chamber 11, and the high-pressure gas supplied by the pressure source P into the pressure chamber 12 is allowed to build up to the predetermined pressure level.

Figure 8:
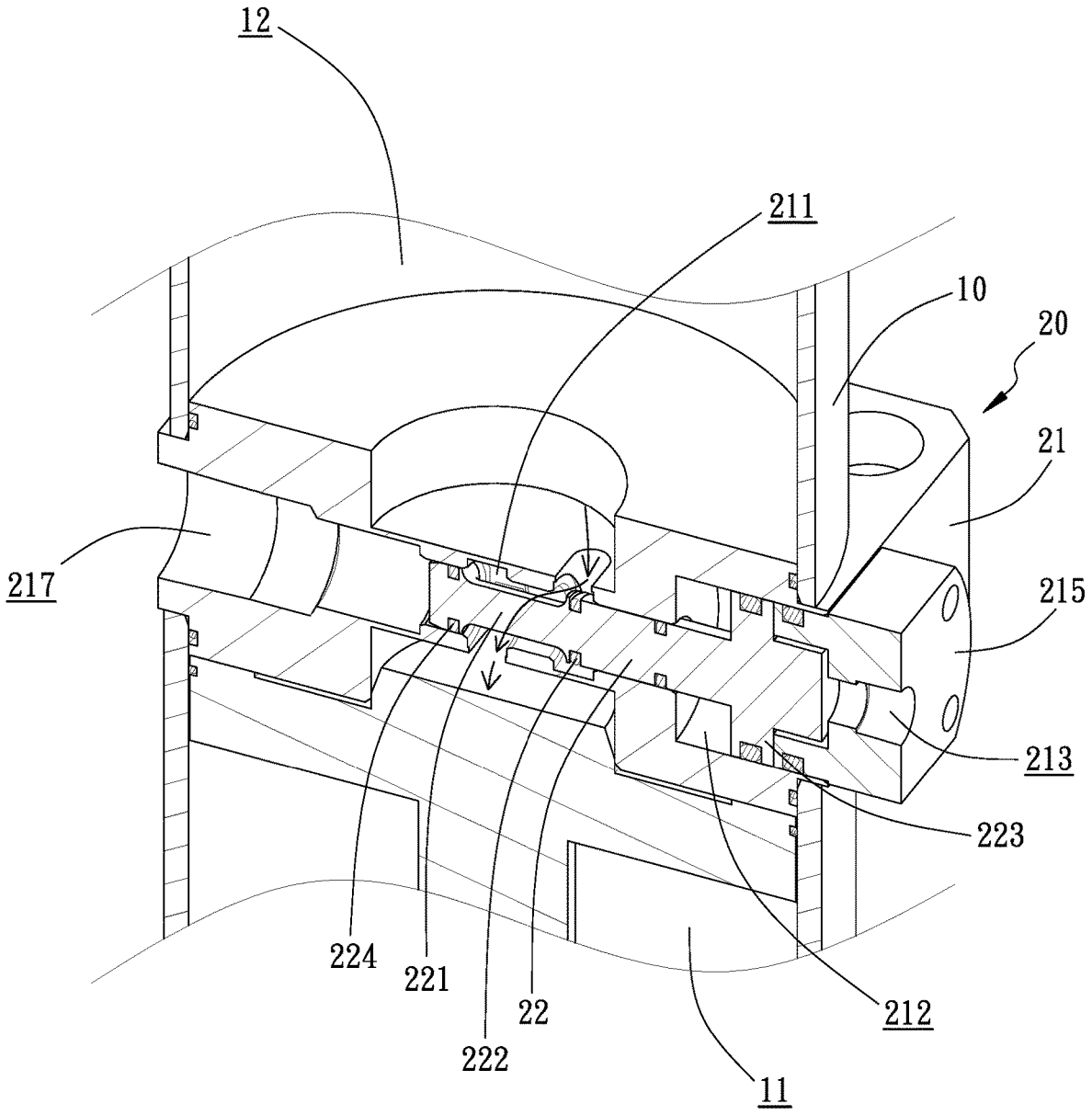
FIG. 8 is an enlarged cut-away view of a part of the accelerator-equipped pneumatic cylinder of the present invention, showing that the piston chamber and the pressure chamber are communicated with each other, and high-pressure medium in the pressure chamber passes through a channel to enter the piston chamber.
Figure 9:
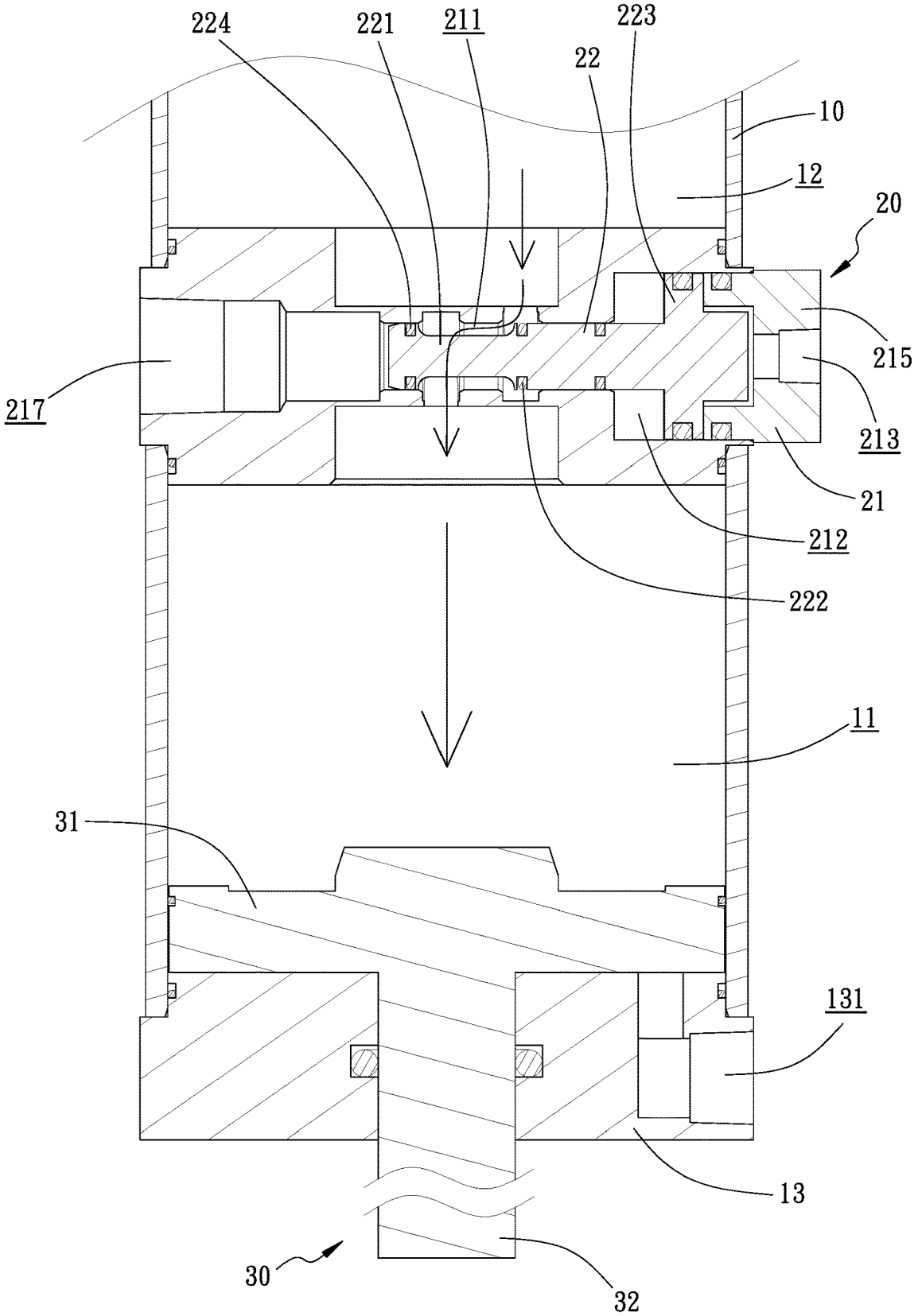
FIG. 9 is an enlarged cross-sectional view of a part of the accelerator-equipped pneumatic cylinder of the present invention, showing that the high-pressure medium pushes the piston portion at an accelerated speed to make the shaft portion extend outside the piston chamber.

For unclamping operation, as shown in FIG. 7, the two-way solenoid valve 40 is power and magnetically excited in an opposite direction, so the pressure source P supplies the high-pressure gas into the operation chamber 212 through the second runner 214 instead to push the drive portion 223 reversely. At this time, the high-press gas in the operation chamber 212 is drained through the first runner 213. This makes the valve stem 22 to move axially and thereby retracts the front retaining ring 222 from the channel 211, thereby opening the channel 211 (as shown in FIGS. 8 and 9). At the moment when the channel 211 is opened and the piston chamber 11 and the pressure chamber 12 come into communication with each other, the piston portion 31 is pushed by the high-pressure gas at the predetermined pressure level in a very short period, so the shaft portion 32 makes the dash outward the piston chamber 11 for unclamping a tool. At the time the shaft portion 32 is pushed out the piston chamber 11 for the unclamping operation, the one-way solenoid valve 50 makes the pressure source P and the first through hole 131 become communicated with each other, thereby forming a return passage that enables gas release through the first through hole 131.

Alternatively, before the shaft portion 32 is pushed out the piston chamber 11 for unclamping operation, the one-way solenoid valve 50 may make the pressure source P and the first through hole 131 come into communication with each other in advance, so that the high-pressure gas can be drained from the piston chamber 11 through the first through hole 131. This allows the shaft portion 32 come out the piston chamber 11 and make the dash more effectively. Furthermore, while the one-way solenoid valve 50 in the depicted embodiment is a stand-alone device that is desiccated in gas release, there may be other embodiments where a solenoid valve is additionally attached to the switch valve 20 for providing the same function of gas release.

After the unclamping operation is completed, the two-way solenoid valve 40 introduces the pressure medium from the pressure source P into the operation chamber 212 through the first runner 213, so as to push the drive portion 223, which in turn drives the valve stem 22 to move axially to make the front retaining ring 222 enter the channel 211 again, thereby closing the channel 211 (as shown in FIG. 3). The one-way solenoid valve 50 introduces the pressure medium from the pressure source P into the piston chamber 11 reversely to push the piston portion 31, so as to return the shaft portion 32 into the piston chamber 11 (as shown in FIG. 6), and form a return passage in the second through hole 217 for gas release, thereby returning to the initial state prior to the unclamping operation.

As can be seen from the above description, the present invention features that with the cylinder block 10 having the pressure chamber 12, the pressure medium from the pressure source P can be introduced into the pressure chamber 12 in advance and build up to the predetermined pressure level, so as to act as a driving force that pushes the shaft portion 32 out the piston chamber 11. In its application for unclamping operation, when a tool attached to a spindle (not shown) is to be changed, the controller (i.e. the valve stem 22 as describe previously) makes the pressure chamber 12 and the piston chamber 11 come into communication with each other. At this time, the piston portion 31 is pushed out the piston chamber 11 by the pressure medium at an accelerated speed in a very short period and thereby makes a dash to fulfill the unclamping operation. The disclosed cylinder block 10 has the pressure chamber 12 in addition to the piston chamber 11, and uses the controller to allow the shaft portion 32 to come out the piston chamber 11 with a dash. As compared to the foregoing conventional unclamping cylinder that has to be equipped with two actuator units and uses to switches as well as two pressure sources, the present invention involves fewer and simpler components, thereby saving costs. Additionally, since the pressure chamber 12 of the cylinder block 10 allows the pressure medium from the pressure source P to be introduced and accumulated to the predetermined pressure level prior to the intended unclamping operation, even in the event of failure or shortage of the external compressed-air source, the pressure medium accumulated in the pressure chamber 12 can be used to push the shaft portion 32 out the piston chamber 11, thereby effectively preventing failure of the unclamping operation.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An accelerator-equipped pneumatic cylinder, comprising:

a cylinder block, having a piston chamber and a pressure chamber;

a switch valve, having a valve seat installed in the cylinder block and between the piston chamber and the pressure chamber, the valve seat having a channel and receiving a controller that makes the piston chamber and the pressure chamber communicated with each other or not by opening or closing the channel; and a pneumatic cylinder, having a piston portion receiving in the piston chamber, and having a shaft portion extending outward from one side of the piston portion to be exposed outside the cylinder block, so that when the channel is closed by the controller and the piston chamber and the pressure chamber are not communicated with each other, a pressure medium supplied into the pressure chamber by a pressure source is accumulated to a predetermined pressure level, and at a moment when the channel is opened by the controller and the piston chamber and the pressure chamber come into communication with each other, the piston portion is pushed by the pressure medium at the predetermined pressure level, so that the shaft portion is pushed out the piston chamber at an accelerated speed; wherein, the controller is a valve stem, and the valve stem is received in the valve seat in an axially movable manner and passes through the channel, in which the valve stem has a small-diameter segment with a reduced diameter, and the small-diameter segment is positionally aligned with the channel, the valve stem having one end with the small-diameter segment provided with a front retaining ring, so that when the valve stem axially moves in the valve seat to make the front retaining ring enter the channel, the channel is closed, and when the front retaining ring is retracted from the channel, the small-diameter segment allows the channel to become open; and the valve seat defines therein an operation chamber, whose two ends provided with a first runner and a second runner, respectively, to communicate with the outside of the valve seat, in which the valve stem has one end provided with a drive portion that is received in the operation chamber, so that the pressure source is configured to enter the operation chamber through the first runner and to push the drive portion and then drive the valve stem to axially move to make the front retaining ring enter the channel so as to close the channel, and the pressure source is also configured to enter the operation chamber through the second runner to reversely push the drive portion and then drive the valve stem to axially move to retract the front retaining ring from the channel so as to open the channel.

2. The accelerator-equipped pneumatic cylinder of claim 1, wherein the first runner and the second runner are connected to a solenoid valve, respectively, and further connected to the pressure chamber, so that the solenoid valve controls the pressure source to supply the pressure through the first runner or through the second runner.

3. The accelerator-equipped pneumatic cylinder of claim 1, wherein the valve seat has a flange at the first runner, and the flange protrudes from the valve seat.

4. The accelerator-equipped pneumatic cylinder of claim 1, wherein the cylinder block has a first end cap at one end of the piston chamber, and the cylinder block has a second end cap at one end of the pressure chamber, in which the first end cap has a first through hole communicated with the piston chamber, and the valve seat has a second through hole communicated with the channel.

5. The accelerator-equipped pneumatic cylinder of claim 4, wherein the first through hole is communicated with the pressure chamber, and a one-way solenoid valve is provided between the first through hole and the pressure chamber, so as to communicate the pressure source with the first through hole, and thereby allow a return passage to be formed at the moment when the shaft portion is pushed outside the piston chamber at the accelerated speed, or to connect the pressure source to the piston chamber in an opposite direction so as to push the piston portion to return to the piston chamber, and thereby allow a return passage to be formed in the second through hole.

6. The accelerator-equipped pneumatic cylinder of claim 5, wherein the valve stem has a rear retaining ring at one end with the small-diameter segment, so that when the valve stem axially moves to make the front retaining ring close the channel, the channel becomes communicated with the second through hole, and when the valve stem axially moves to retract the front retaining ring from the channel to make the channel open, the rear retaining ring closes the second through hole and make the channel and the second through hole not communicated with each other.

7. The accelerator-equipped pneumatic cylinder of claim 1, wherein the valve seat has a communicating hole, which communicates with the pressure chamber, and the communicating hole is configured to allow the pressure source to supply the pressure into the pressure chamber where the pressure accumulated into the predetermined pressure level, or allow the pressure at the predetermined pressure to be released from the pressure chamber.

* * * * *